United States Patent [19]

Claassen

[11] Patent Number: 4,798,163

[45] Date of Patent: Jan. 17, 1989

[54] SLIT NOZZLE

[75] Inventor: Henning J. Claassen, Lüneburg, Fed. Rep. of Germany

[73] Assignee: Meltex Verbindungs-Technik GmbH, Lüneburg, Fed. Rep. of Germany

[21] Appl. No.: 190,725

[22] Filed: May 5, 1988

Related U.S. Application Data

[63] Continuation of Ser. No. 934,963, Nov. 25, 1986, abandoned.

[30] Foreign Application Priority Data

Nov. 26, 1985 [DE] Fed. Rep. of Germany ..... 3541784

[51] Int. Cl.[4] ..... B05C 5/02

[52] U.S. Cl. ..... 118/410; 118/419

[58] Field of Search ..... 118/410, 411, 419; 425/113

[56] References Cited

U.S. PATENT DOCUMENTS

| | | | |
|---|---|---|---|
| 489,969 | 1/1893 | Livingston . | |
| 2,652,345 | 9/1953 | Jones . | |
| 2,681,294 | 6/1954 | Beguin | 118/410 X |
| 2,726,632 | 12/1955 | Asbeck | 118/410 |
| 2,761,791 | 9/1956 | Russell | 118/412 |
| 3,078,824 | 2/1963 | Bechle | 118/410 |
| 3,126,574 | 3/1964 | Fox | 118/411 X |
| 3,174,689 | 3/1965 | McIntyre | 239/70 |
| 3,206,323 | 9/1965 | Miller | 118/410 X |
| 3,259,323 | 7/1966 | Sanders | 239/585 |
| 4,048,950 | 9/1977 | Rakowicz et al. | 118/411 X |
| 4,299,186 | 11/1981 | Pipkin et al. | 118/407 |
| 4,466,378 | 8/1984 | Rogers et al. | 118/411 |

FOREIGN PATENT DOCUMENTS

| | | |
|---|---|---|
| 842267 | 9/1952 | Fed. Rep. of Germany . |
| 1163650 | 2/1964 | Fed. Rep. of Germany . |
| 1166456 | 10/1964 | Fed. Rep. of Germany . |
| 1928025 | 12/1969 | Fed. Rep. of Germany . |
| 2100771 | 7/1971 | Fed. Rep. of Germany . |
| 2836545 | 3/1980 | Fed. Rep. of Germany . |
| 597928 | 4/1978 | Switzerland . |

*Primary Examiner*—John McIntosh

*Attorney, Agent, or Firm*—Armstrong, Nikaido, Marmelstein & Kubovcik

[57] ABSTRACT

A device for applying liquid adhesive, in particular hot-melt adhesive, comprises a reservoir for the adhesive, an application nozzle for the adhesive and a shutoff valve in the line from the reservoir to the nozzle which is constructed as slit nozzle whose slit emanates from a spreading chamber to which the adhesive is supplied through a passage which opens centrally into the chamber at an angle to the direction in which the slit adjoins the chamber; the chamber extends substantially on the one side of the slit and the passage projects from the other side of the slit into the chamber.

4 Claims, 2 Drawing Sheets

FIG. 2
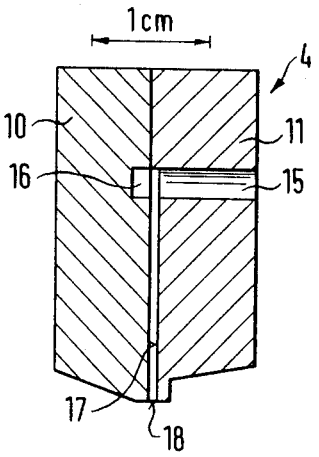
FIG. 3
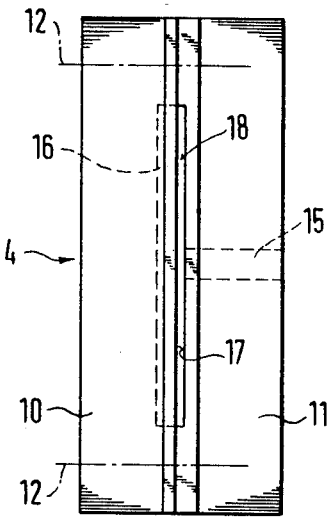
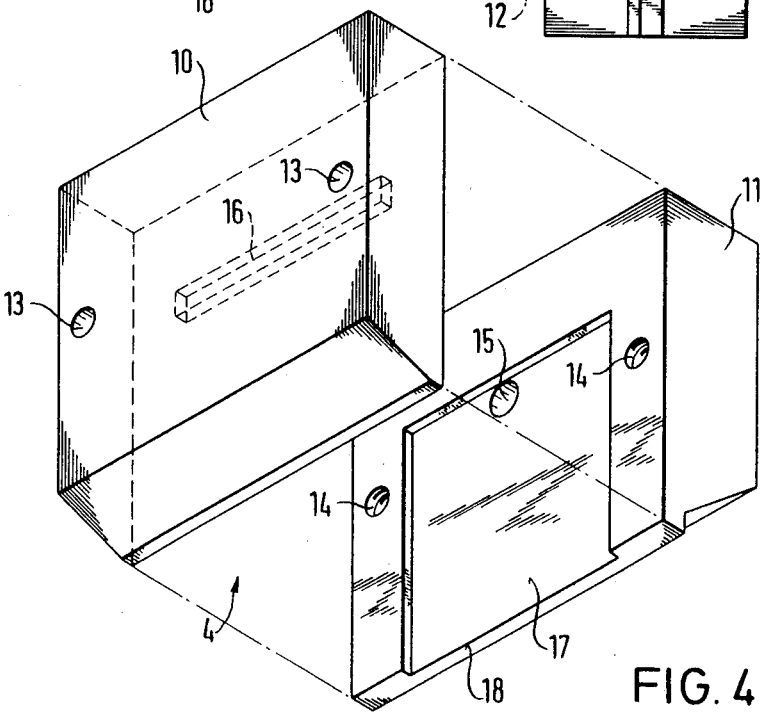
FIG. 4

SLIT NOZZLE

This is a continuation, of application Ser. No. 934,963 filed Nov. 25, 1986, now abandoned.

BACKGROUND OF THE INVENTION

1. Field of the Invention

The invention relates to a device for applying liquid adhesive, in particular hot-melt adhesive, comprising a reservoir for the adhesive, an application nozzle for the adhesive and a shutoff valve in the line from the reservoir to the nozzle which is constructed as slit nozzle whose slit emanates from a spreading chamber to which the adhesive is supplied through a passage which opens centrally into the chamber at an angle to the direction in which the slit adjoins the chamber.

2. Description of the Prior Art

Such a device for applying adhesive is known from U.S. Pat. No. 3,126,574. Admittedly, the known device does not have an exit slit as used for covering closed surfaces with adhesive but a plurality of adjacent exit bores extending parallel to each other in a common plane. These bores are however considered equivalent to an exit slit. Accordingly, the present invention is intended also to cover a configuration of the nozzle in which the slit is replaced by an equivalent array of bores with the aid of which instead of an adhesive layer a field of adhesive strands can be applied to the material to be coated, usually a web moved past beneath the nozzle. In the known device the spreading or dispersion chamber is formed by a bore. From said bore at an angle of about 45° the thin outlet bores extend, said bores running parallel to each other in a common plane containing the axis of the bore and their diameter being a small fraction of the diameter of the spreading chamber. Into the centre of the spreading chamber a horizontally extending supply passage opens which is preceded by a valve means. Said valve means serves to interrupt the application of adhesive whenever the discharge means is raised from the material to be coated. In this manner an intermittent application of the adhesive is made possible.

The spreading chamber has a relatively large cross-section so that as is generally usual in the extrusion by means of wide slit nozzles it permits a good distribution of the adhesive across the width of the nozzle or the width of the row of exit bores. For the same reason on such nozzles the length of the exit slit is normally constant over the width and the spreading chamber extends parallel to the exit opening of the slit over the entire width thereof.

The known device is not very suitable for working at high relative speed between the material to be coated and the nozzle. This is due firstly because of the valve means used in the known construction. However, the valve means wll not be discussed in detail here because it is not the subject of the invention. Rapidly closing and opening valve means are known per se. A further defect of the known arrangement resides in that in particular when said relative speed is high and adhesive, in particular a hot-melt adhesive, is to be applied only intermittently over short lengths the application at the start of the section to be coated with adhesive and at the end thereof tends to be irregular.

SUMMARY OF THE INVENTION

The invention therefore has as its object the provision of a device of the type indicated having an improved nozzle so that not only an optimum distribution of the adhesive over the entire width of the slit or exit bore row is ensured but moreover even with intermittent application satisfactory separation between uncoated and coated material at the start and end of the application is achieved. Furthermore, the nozzle of the invention is to be of simple structure.

The invention therefore proposes in a device for applying liquid adhesive, in particular hot-melt adhesive, comprising a reservoir for the adhesive, an application nozzle for the adhesive and a shutoff valve in the line from the reservoir to the nozzle which is constructed as slit nozzle whose slit emanates from a spreading chamber to which the adhesive is supplied through a passage which opens centrally into the chamber at an angle to the direction in which the slit adjoins the chamber, the improvement that the chamber extends substantially on the one side of the slit and that the passage projects from the other side of the slit into the chamber.

Nozzles having such a structure have proved themselves even at working speeds of 300 m/min between nozzle and material to be coated and a working pressure of the hot-melt adhesive to be applied of the order of magnitude of 50 bar and more. Applicants are unable to say exactly why such advantageous results are obtained as regards the adhesive application with the configuration according to the invention in which the adhesive first flows across the width of the slit into the spreading chamber and then back out of the latter and downwardly into the exit slit. However, it has been found that with regard to the application of the adhesive a very significant improvement is obtained with the configuration according to the invention even when with very high speeds as indicated above the application is interrupted with a correspondingly high frequency several times a second.

It is obvious that for this purpose a satisfactory rapidly closing and opening valve is required which is preferably connected to the spreading chamber only via a short supply passage. The longer the distance from the valve to the exit opening of the slit the more disadvantageous for a satisfactory application at the start and end of each coating section.

Whereas the supply passage preferably has the form of a cylindrical bore whose diameter is substantially equal to the edge length of the spreading chamber, which advantageously has a square profile, the thickness of the slit is relatively small, conveniently being made about $\frac{1}{4}$ to $\frac{1}{8}$ of the edge length of the chamber. Fundamentally, the chamber need not of course have a square profile. It may for example also be rounded out at a side opposite the passage mouth. Furthermore, in the centre region opposite the passage mouth it may have a greater extent in the direction of the passage than in the regions more remote from the passage so that the crossflow cross-section in the spreading chamber decreases with increasing distance from the supply passage. This is however not decisive. A simple square constant profile over the length of the spreading chamber, i.e. over the entire width of the slit, has proved exceedingly good in practice.

Preferably, the passage-side walls of the slit and chamber coincide. From the fluid mechanics point of view the exit is through the wall of the spreading chamber defining said chamber in the direction of the flow in the slit.

With a nozzle according to the invention in practice a web and the like led past the nozzle at any desired angle can be coated. Preferably the nozzle and the web material to be coated are however so arranged that the exit slit of the nozzle extends perpendicularly from the top to the bottom and the web material is moved past horizontally beneath the stationary nozzle.

Preferably, the cross-section of the chamber is somewhat greater than the cross-section of the passage or exceeds the latter slightly, for example by 20 to 30%. The expression cross-section of the passage here means the cross-section thereof in a plane normal to the flow direction in the passage. Cross-section of the chamber means the cross-section thereof in a plane normal to the direction of the greatest extent thereof, i.e. in the preferred embodiment in a plane extending parallel to the direction of the supply passage and perpendicularly, the passage preferably opening into the chamber substantially perpendicularly to the extent of the slit, i.e. extending horizontally in the preferred embodiment.

From the constructional point of view the nozzle comprises according to an advantageous further development two main parts or first and second members which are tensioned with respect to each other, which is usually done by means of two screws which project through passage holes in the one main part into threaded holes in the other main part. The slit in one of the main parts is made as flat recess in the face adjoining the other main part. The passage then extends through one of the main parts whilst the chamber is provided in the other main part. Such a design is constructionally exceedingly simple and involves low production costs. Fundamentally, of course, other configurations are also possible; for example the spreading chamber, as mentioned in the prior art referred to at the beginning, can also be formed by a bore which is introduced from one side into the nozzle body and subsequently again sealed. In such a construction the exit slit opens tangentially into the bore forming the spreading chamber in said region, in which, preferably perpendicularly to the plane of the exit slit, the supply passage opens into the spreading chamber. Also, for example, the spreading chamber and slit may be recessed in one main part and the supply passage in the other.

BRIEF DESCRIPTION OF THE INVENTION

The invention will be explained in more detail hereinafter with reference to an example of embodiment with the aid of the drawings, wherein:

FIG. 2 shows a vertical section through the centre of the coating nozzle of the device according to FIG. 1 to an enlarged scale which is indicated above FIG. 2.

FIG. 3 is a view of FIG. 2 from below.

FIG. 4 shows in perspective exploded view the two main parts forming the nozzle according to FIGS. 2 and 3, lines which are not visible being shown only to the extent necessary for the understanding of the drawings.

DESCRIPTION OF THE PREFERRED EMBODIMENT

Figure 1:
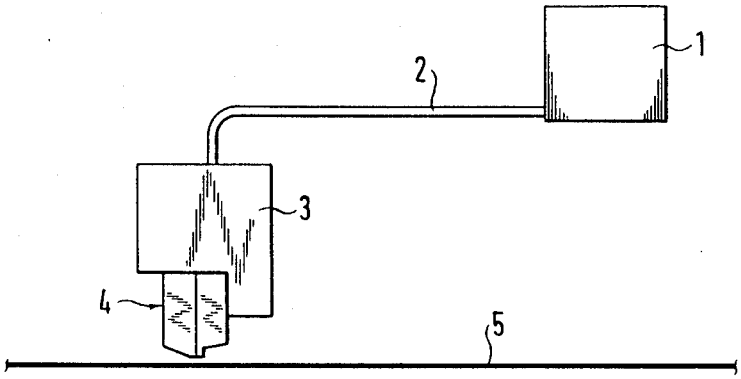
FIG. 1 shows the side view of a device according to the invention which is to be used for coating a web led therebeneath intermittently with a hot-melt adhesive.

The device illustrated in FIG. 1 diagrammatically has a melting means 1 for the hot-melt adhesive in which the latter is molten and collected in the molten state in a basin. Extending from said basin is a line 2 through which the liquid hot-melt adhesive is supplied by means of a pressure pump provided in the unit 1 at a correspondingly high pressure to the application head 3. The application head 3 includes the valve means which makes it possible to apply the hot-melt adhesive emerging from the nozzle 4 disposed at the bottom of the application head 3 in desired lengths to the web 5 moved beneath the nozzle 4. Depending on the valve design chosen a return line can also be provided for hot-melt adhesive from the application head 3 to the unit 1. Said return line is necessary whenever the valve means for supplying the nozzle 4 is one in which the supply flow is not simply shut off but instead the hot-melt adhesive flowing through the line 2 when the valve is switched to nonapplication is introduced without retardation into a return line, not shown, which leads to the unit 1.

The application nozzle 4 is shown in detail in FIGS. 2 to 4.

The application nozzle consists essentially of two relatively thick plane-parallel plates or members 10 and 11 which are screwed with their faces against each other by means of two screws which are not shown. In FIG. 3 the centre lines 12 of the screws are shown. In FIG. 4 the passage holes 13 can be seen in the plate 10 for the screws and the thread holes 14 in the plate 11. The nozzle 4 is screwed in a manner not illustrated from below against the application head 3 in such a manner that the horizontal supply passage 15 adjoins a corresponding line in the head 3. The supply passage 15 is formed by a bore 15 extending perpendicularly through the plate 11. Opposite the left end of the bore 15 in FIG. 2 the spreading chamber 16 is disposed. The spreading chamber 16 has a substantially square cross-section. ¾ thereof is formed by a milled recess extending in the same horizontal plane as the bore 15 in the face of the plate 10 on the right in FIG. 2 and remote from the observer in FIG. 4. It has the same width, i.e. the same extent in FIG. 2 perpendicularly to the plane of the drawing, as the exit slit which is formed by a flat milled recess in the left surface of the plate 11 in FIG. 2. The upper region of this milled recess forms at the same time a part of the chamber 16 as best seen from FIG. 2. The exit slit 17 extends from the boundary face of the spreading chamber 16 facing the passage 15 perpendicularly downwardly. Its exit opening 18 extends horizontally and parallel to the spreading chamber 16. As best seen from FIG. 4 the two lateral boundaries of the slit run parallel to each other and perpendicularly to the edge 18 and the spreading chamber 16.

As best apparent from FIG. 4 the nozzle 4 according to the invention has an extremely simple construction because it requires only the bore forming the passage 15, the milled recess forming the slit 17 and the recess in the other plate forming the spreading chamber 16.

In the invention the spreading chamber may also be made of variable size. For this purpose it suffices to make said chamber continuous in FIG. 4 from the side remote from the observer up to the side facing the observer and close said chamber again for example by a filling member adjustable by means of screws. Similarly, the width of the exit slit 18 may also be variable. This can for example be achieved in that opposite the recess 17 in the plate 11 an analogous recess is provided in the plate 10 which extends over the entire thickness of the plate 10 and is filled by means of an adjustable block to such an extent that only the slit 17 of desired thickness remains.

I claim:

1. A nozzle for a liquid adhesive applicator comprising:

first and second members having interfacing surfaces defining an adhesive exit slit therebetween, a spreading chamber in one of said interfacing surfaces of one of said members, and a supply passage opening through the interfacing surface of the other said member into said spreading chamber at an angle relative to said exit slit, said supply passage comprising the only opening through said interfacing surface of said other member and having a relatively narrow cross-section compared to the cross-sectoin of said spreading chamber, said exit slit emanating from said spreading chamber with said supply passage on one side of said exit slit and said spreading chamber entirely on the other side of said exit slit.

2. A nozzle according to claim 1, wherein the width of the spreading chamber is coextensive with the width of the exit slit.

3. A nozzle according to claim 1, wherein the supply passage opens into the spreading chamber substantially perpendicular to the direction of the exit slit.

4. A nozzle according to claim 1, wherein said first and second member are tensioned with respect to each other and said exit slit is formed as a flat recess in interfacing surface of one of said first and second members.

* * * * *